US005509550A

United States Patent [19]

DeJonge

[11] Patent Number: 5,509,550

[45] Date of Patent: Apr. 23, 1996

[54] CHILD RESISTANT CAP WITH AUTOMATIC RELEASE KEY

[75] Inventor: Stuart W. DeJonge, Easton, Pa.

[73] Assignee: Primary Delivery Systems, Inc., Easton, Pa.

[21] Appl. No.: 368,985

[22] Filed: Jan. 5, 1995

[51] Int. Cl.[6] ..... B65D 55/02; A61J 1/00

[52] U.S. Cl. ..... 215/204; 215/221; 215/206; 215/215

[58] Field of Search ..... 215/201, 204, 215/206–207, 215–219, 221–222, 277, 302–305

[56] References Cited

U.S. PATENT DOCUMENTS

| | | | |
|---|---|---|---|
| 3,160,301 | 12/1964 | Milbourne . | |
| 3,240,373 | 3/1966 | Dulle . | |
| 3,396,864 | 8/1968 | Jones et al. | 215/215 |
| 3,501,041 | 3/1970 | Schaefer . | |
| 3,520,435 | 7/1970 | McIntosh | 215/220 |
| 3,684,115 | 8/1972 | Birch . | |
| 3,698,585 | 10/1972 | Smith et al. . | |
| 3,869,058 | 3/1975 | Bogert . | |
| 4,281,771 | 8/1981 | Siegel . | |
| 4,711,363 | 12/1987 | Marino . | |
| 4,854,459 | 8/1989 | DeJonge . | |
| 5,115,928 | 5/1992 | Drummond, Jr. | 215/220 X |
| 5,234,118 | 8/1993 | Fillmore et al. | 215/206 X |

*Primary Examiner*—Allan N. Shoap
*Assistant Examiner*—Nathan Newhouse
*Attorney, Agent, or Firm*—Kenneth P. Glynn

[57] ABSTRACT

The child resistant cap device is for containers with a threaded neck openings. It includes an inner cap, an outer cap and a key bar. The inner cap has a top and a sidewall having threads on its inside. The sidewall has on its outside, one of a male attaching mechanism and a female attaching mechanism for receiving and attaching the outer cap onto the inner cap so as to be rotatably fixed thereon. The top of the inner cap has a release key engagement on its outside, and the outside of the inner cap also has one way ratchets or ratchet blocks to permit engagement of the outer cap for rotating thereon, in a single, closing direction and preventing engagement of them for rotating them in a single, opposite, opening direction. The outer cap has a top and a sidewall having on its inside the other of a male attaching mechanism and a female attaching mechanism. The top of the outer cap has a release key bar with a key which is pivotable for 180° rotation so as to be engageable with the key arrangement of the inner cap so as to permit opening of the inner cap by rotation of the outer cap when the release key is engaged in the release key engagement.

16 Claims, 2 Drawing Sheets

CHILD RESISTANT CAP WITH AUTOMATIC RELEASE KEY

BACKGROUND OF THE INVENTION

1. Field of the Invention

The present invention is directed to a child resistant cap and, more particularly, to a child resistant cap device with an automatic release key mechanism. The present invention device relies upon an inner cap and an outer cap, as well as a pivoting key bar and release key, as more fully described herein. The present invention device may typically be utilized for securing medicine and other materials which are stored in a threaded neck container and may be hazardous to small children.

2. Information Disclosure Statement

The field of child resistant caps is abundant, with thousands of variations in functionability and design, and the following is exemplary of systems using inner caps and outer caps:

U.S. Pat. No. 3,240,373 to Dulle describes a closure with a side type dispenser wherein a release lock tab prevents opening of the slide unless it is first released.

U.S. Pat. No. 3,160,301 to Milbourne describes a safety closure mechanism which uses a key and slot wherein the key is attached to an outer cap with a resilient, flexible strap.

U.S. Pat. No. 3,501,041 to Schaefer describes a safety bottle cap for preventing unauthorized opening or access to the contents of a bottle. An inner cap member is enclosed by a sleeve member, and connecting means carried by the members provides for relative rotational and axial movement therebetween. Engagement of a separable locking means with the cap and sleeve members locks the members against relative rotational movement and thus permits threaded engagement or disengagement of the cap from the bottle. Disengagement of the locking means from the cap and sleeve members frees the members for relative rotational movement and thus prevents removal of the cap by rotation of the sleeve member. The length of the sleeve member and the arrangement of the connecting means is such that the latter conceals different length threads on different bottles when the cap is engaged therewith.

U.S. Pat. No. 3,684,115 to Birch describes a childproof safety closure of two parts, one part having a skirt with internal screw threads to form a conventional screw cap closure, the second part being an overcap completely covering the threaded closure member and being freely rotatable in relationship thereto, said overcap having on its top a projecting stud and a similar shaped opening which serves as a key for unscrewing the inner closure member of another closure of similar construction.

U.S. Pat. No. 3,698,585 to Smith, et al. describes an inner cap member adapted for being threaded onto the neck of a bottle for closing the opening therein mounts on an outer cap member which interlocks with the inner cap member when it is turned in a direction to apply the inner cap member to the bottle. When turned in the opposite direction, i.e., in a direction to remove the inner cap member from the bottle, the outer cap member normally does not interlock with the inner cap member, as a consequence of which it turns freely about the inner cap member without turning the same. However, it may be made to interlock with the inner cap member when it is desired to remove the same from the bottle.

U.S. Pat. No. 3,869,058 to Bogert is related to a safety closure for a container which is provided to prevent inadvertent opening of the container and exposure of the contents to children and others who may be unaware of the nature of the contents. The closure includes an inner cap having an internal threaded portion to be attached to the threads on the neck of the container and an outer cap overlying the inner cap. The top of the inner cap has a raised plate or ledge which is tapered and is provided with notches extending inwardly of the outer rim and a spring centrally located on the top of the inner cap. The underside of the top of the outer cap has tracks to form a guideway and a stop. A slide is disposed on the guideway between the inner and outer cap and engages the stop to prevent lateral movement of the slide. The top also has an aperture over the slide. When normally assembled the outer cap will freely rotate around the inner cap without moving the inner cap. When the slide is depressed by pressure exerted through the aperture against the action of the spring, the slide is moved to disengage the slot from the stop and partially out of the guideway. When the outer cap is then rotated in the appropriate direction, the side moves with it into engagement with one flat surface or edge of the ledge on the inner cap and causes the inner cap to turn so that it can move on the threads for removal from the neck of the container. After obtaining the desired amount of the contents, the closure assembly is then again placed on the container and the outer cap is turned in the other direction causing the slide to move with it into engagement with the other flat surface or edge of the raised plate. The inner cap is then turned on the threads until it is secured to the container. Further rotation of the outer cap will cause the slide to sequentially engage on the notches and moves toward its original position in the guideway whereupon the slide can then be moved to reengage the slot and the stop.

U.S. Pat. No. 4,281,771 to Siegel describes a child-resistant/non-child-resistant dual function double cap closure with incorporated means for over-ride of conventional normally disengaged torque couplings includes a hole formed in the top surface of the outer cap, a formed plug having a locking protuberance and removal ring, and a plurality of spaced stop lugs formed annularly on the top surface of the inner cap. The free and separate movement of the outer cap is prevented in either direction of rotation by the plug's insertion into the hole of the outer cap as to place the base of the plug in the space between the stop lugs of the inner cap rendering the cap non-child-resistant at the time of consumer purchase. The consumer may use the cap in a non-child-resistant mode or remove the plug thus converting the cap to a child-resistant mode.

U.S. Pat. No. 4,711,363 to Marino describes a tamper evidencing closure for use on containers containing food stuffs and the like comprises multiple cap configuration intrically joined to a closure by a live hinge. A secondary cap is formed within the first with frangible tamper evidence strips and a secondary live hinge. A tubular plug depends from the underside of said secondary cap and is registerable into a dispenser opening within the closure. Assembly pins secure the cap to the closure and a annular rib on the tubular plug forms a deal around the dispensing opening when the tubular plug is in closed position and holds the secondary cap and plug in closed position once the frangible tear strips are broken.

U.S. Pat. No. 4,854,459 to DeJonge is related to a present invention which involves a container and cap which is generally childproof and may be rendered non-childproof permanently. The invention involves a container having a cylindrical neck at the top and threads molded about the exterior of the neck as well as an inner cap and outer cap.

The inner cap has a top and cylindrical side wall with threads molded on the inside of the side wall so as to mate with the threads of the container. The top or side of the inner cap has ratchet type segments on its outside and the outer cap has ratchet type segments on the inside of its top or side. The outer cap has a cylindrical side wall and is usually freely rotatable about the inner cap so as to be childproof. When in the childproof configuration as described, downward pressure is required by the user so as to engage the two ratchet type segments and thereby engage the two caps to permit opening. Further, the outer cap has an opening in its side wall at a level near the bottom of the side wall of the inner cap and also has integrally attached thereto a flexible connector and stop. The flexible container and stop are located so as to permit insertion of the stop into the opening so as to extend beyond the opening and push up the inner cap so as to permanently lock it into a position wherein the inner cap and outer cap ratchet type segments are permanently engaged. This renders the cap permanently non-childproof.

U.S. Pat. No. 5,115,928 is related to a convertible child-resistant closure assembly. It includes a closure and shell. The shell mounts a latching key and the closure provides a complementary latch. An alignment structure provides for aligning the latch and key for movement of the latching key from a mode in which the key is inactive to a mode in which it engages the latch to inactive the child-resistant function of the closure. In that position the shell and closure are corotatable in both clockwise and counter-clockwise directions. Spring fingers may be provided to elevate the shell relative to the closure to provide an additional child-resistant function. The latching key may be hingedly or slideably secured to the shell.

Notwithstanding the above prior art, there is no teaching or suggestion of obviousness therein respecting the present invention child-resistant safety cap device described herein.

SUMMARY OF THE INVENTION

The present invention child resistant cap device is for containers with a threaded neck openings. It includes an inner cap, an outer cap and a key bar. The inner cap has a top and a sidewall having threads on its inside for threading to a container. The sidewall has on its outside, one of a male attaching mechanism and a female attaching mechanism for receiving and attaching the outer cap onto the inner cap so as to be rotatably fixed thereon. The top of the inner cap has a release key engagement on its outside, and the outside of the inner cap also has one way ratchets or ratchet blocks to permit engagement of the outer cap for rotating thereon, in a single, closing direction and preventing engagement of them for rotating them in a single, opposite, opening direction. The outer cap has a top and a sidewall having on its inside the other of a male attaching mechanism and a female attaching mechanism. The top of the outer cap has a release key bar with a key thereon so as to be invertable by pivotal rotation of about 180°, to permit protrusion of the key of said key bar through the key orifice so as to be engageable with the key engagement of the inner cap so as to permit opening of the inner cap by rotation of the outer cap when the release key is engaged in the release key engagement. The key bar is generally located on the outside of the top of the outer cap and may be attached to either the outer cap or the inner cap.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

The present invention is directed to a child resistant cap device for containers having a threaded neck opening. There is an inner cap, an outer cap and a key bar with a release key thereon. This device is used for containers having threaded neck openings, such as medicine bottles, vitamin bottles and bottles containing materials which should be kept away from children. The present invention child resistant cap device operates on the basis of an inner cap and an outer cap which are connected to one another so that they may be rotated relative to one another. The inner cap typically will have threads on its inside side wall so as to be removably attachable (screwable) onto a container having a threaded neck. The outer cap and inner cap have one-way ratchets and ratchet blocks so that the caps can be rotated together in a closing manner but not in an opening manner. Thus, the one-way ratchets permit closure but not opening of the inner cap by rotation of the outer cap and, typically, this would be in a clockwise direction. Thus, the device of the present invention can not be removed from a container once it is attached to a container without utilizing the key bar and release key. The application of the torque required to be used to pass over the ratchets in attempting to open the container and in thereby preventing the opening of the container is a matter of choice and, thus, the application torque to the bottle can be whatever may be desired for a particular application.

To remove the present invention cap device from a container, a user will rotate the release bar so as to move it from a first position to a second position and, thereby, insert the release key on the pivot bar through an orifice in the upper cap and engage the release key into an engagement located on the top of the inner cap. When this engagement is completed, the outer cap and the inner cap are locked together and rotation of the upper cap in an opening direction will automatically unscrew and open the inner cap from the container. In some embodiments, the key release bar is attached to the top of the outside of the outer cap and, in some instances, e.g. when the outer cap has a central orifice and the inner cap has a central protrusion, the release bar may be attached to the inner cap, although in general, it is located in the area of the top of the outer cap and, in preferred embodiments, may nest in a recess located thereon.

In preferred embodiments indicia may be used to show the user where to locate the outer cap relative to the inner cap, that is, so that the user may align the release bar key orifice on the outer cap with the key engagement of the inner cap. Indicia are not necessary because the user could simply rotate the outer cap until the user sees the key engagement in the lower cap through the orifice on the outer cap. However, alignment indicia are preferred and may be located on the sides or the top.

Figure 1:
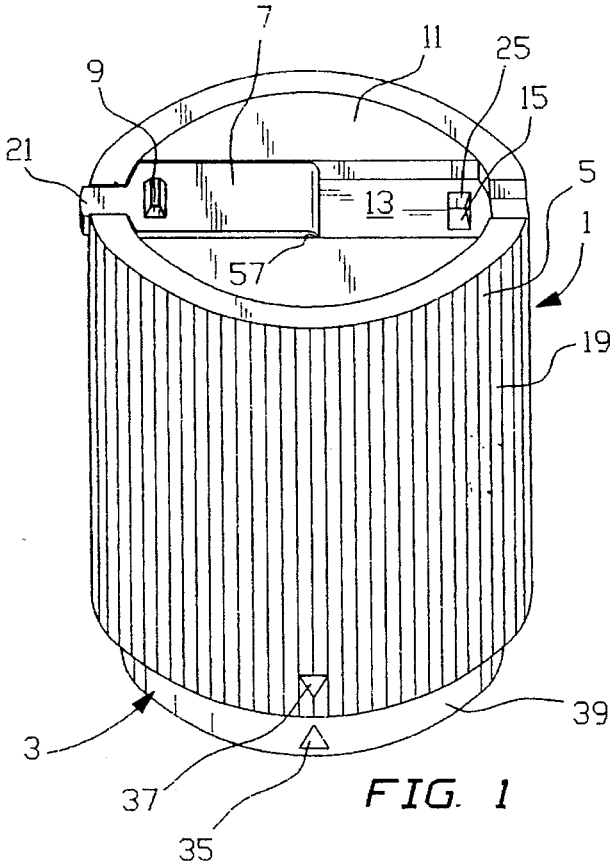
FIG. 1 shows an oblique frontal view of a present invention device.
Figure 2:
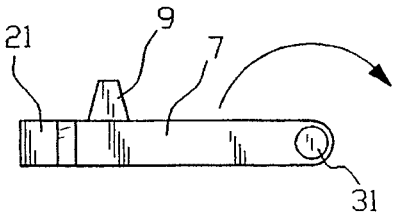
FIG. 2 shows a side view of the key bar and release key of the same device.
Figure 3:
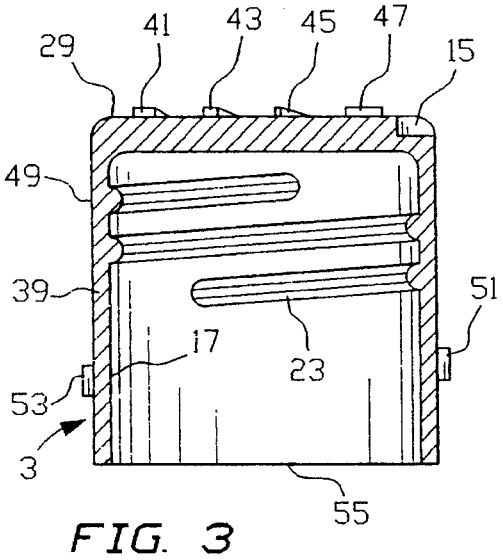
FIG. 3 shows a front cut view of the inner cap of the device shown in FIG. 1; finally.
Figure 4:
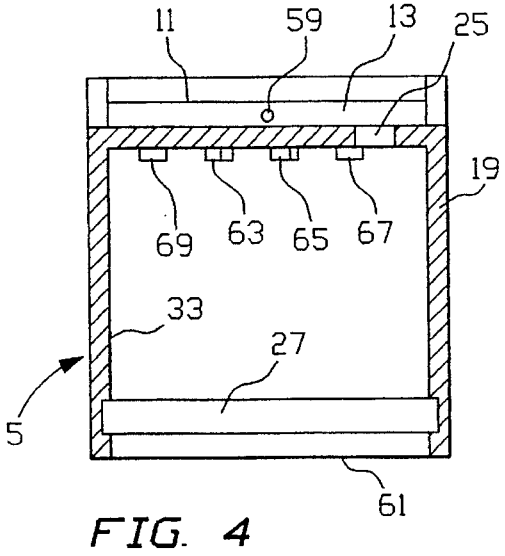
FIG. 4 shows a front cut view of the outer cap used in the device shown in FIG. 1.

Referring now to FIG. 1, there is shown a present invention child resistant cap device 1 having an inner cap 3 and an outer cap 5, as well as a key bar 7. This Figure shows a front perspective view and FIG. 2 shows a side view of key bar 7. FIG. 3 shows a front cut view of inner cap 3 and FIG. 4 shows a front cut view of outer cap 5. The Figures are described herein collectively.

Key bar 7 includes a release key 9 which, in this case, is a protruding member which is somewhat trapezoidal in design, but it could be a block or a column or otherwise without exceeding the scope of the present invention. Also included on key bar 7 is key bar finger grip 21 which extends beyond the top 11 of outer cap 5. There is a recess 13 in top 11 of outer cap 5 for receiving key bar 7. While key bar 7 is shown nested into recess 13 to the left (unengaged, inoperative position), it is hinged by way of pins 57 and 59 which insert into pin receiving orifice 31. The pins 57 and 59 protrude from the wall of recess 13 and the pin receiving orifice 31 is located in the sides of key bar 7 as more fully illustrated in FIG. 2.

Inner cap 3 has on its top a key engagement 15 which, in this case, is a recess which has a flat wall in one direction and a tapered ramp in the opposite direction. This enables key bar 7 to be pivoted or rotated approximately 180°, for example, by a user lifting up key bar finger grip 21 and flipping or pivoting it over. By fully pivoting key bar 7, release key 9 will pass through key orifice 25 located on the top 11 of outer cap 5 and insert into key engagement 15 on inner cap 3. In other words, when key bar 7 is pivoted to its second, operative position, release key 9 will be fitted into key engagement 15, only when proper alignment is first achieved. Inner cap 3 and outer cap 5 may be properly aligned by rotation of outer cap 5 relative to inner cap 3 and alignment of inner cap indicia 35 and outer cap indicia 37. When these indicia (arrows) are aligned, then key orifice 25 of outer cap 5 will be aligned with and directly above key engagement 15 on top 29 of inner cap 3.

Located on the inside of side wall 17 of inner cap 3 are threads 23. These are used for attachment to a threaded neck of a container (not shown). In the manufacture of the present invention device, three components would separately be molded, for example, in the form of a separate key bar 7, a separate inner cap 3 and a separate outer cap 5. The key bar 7 would be snapped onto the pins 57 and 59 so that they would be inserted into pin receiving orifice 31 and outer cap would be slipped onto inner cap 3. Note that outer cap 5 includes a female attachment means 27, in this case a continuous horizontal recess, located on inside wall 33 of outer cap 5. On inner cap 3 at its outside side wall 49, there are a plurality of male attachment means, in this case guide blocks, marked here as attachment means 51 and 53. When outer cap 5 is pushed down over inner cap 3, male attachment means 51 and 53 pop into female attachment means 27. This causes the inner cap 3 and the outer cap 5 to be permanently affixed or attached to one another but in a horizontally rotatable manner. Also, note that female attachment means 27 has a greater height than the male attachment means 51 and 53. While this permits rotation of inner cap 3 within outer cap 5 and vice versa, it also enables the inner cap 3 and outer cap 5 to have slight vertical movement relative to one another. Thus, outer cap 5 also includes ratchet blocks 63, 65, 67 and 69 located on the inside of top 11. Further, inner cap 3 includes on its top 29, a series of one way ratchets 41, 43, 45 and 47. These will, when inner cap 3 and outer cap 5 are connected to one another via female attachment means 27 and male attachment means 51 and 53, may be engageable so as to close inner cap 3 onto a threaded neck of a container but, when the outer cap 5 is rotated in the opposite, opening direction, the blocks 63, 65, 67 and 69 will ride up the ramps of the ratchets, pass over them and will not permit the opening of inner cap 3 via rotation of outer cap 5.

However, when inner cap 3 and outer cap 5 are attached to a container and inner cap 3 is tightened (threaded) onto a container, a user cannot remove the cap device 1 of the present invention unless inner cap 3 is aligned with outer cap 5 (as with the indicia 35 and 37 mentioned above), and then the key bar 7 is flipped all the way over so as to engage release key 9 into key engagement 15 (this locks the inner cap 3 and the outer cap 5 together), and then side wall 19 of outer cap 5 is gripped and rotated in an opening direction, the user will be able to open the cap device 1 of the present invention. Inherent in the design are open bottoms 55 and 61 of inner cap 3 and outer cap 5, respectively, so as to enable a user to engage the two cap units together and to then attach them to a container.

Many variations should now be apparent from the description FIG. 1 above. For example, the indicia could be located on recess 13 and key engagement 15, or key engagement 15 and key orifice 25 could act themselves as indicia in lieu of indicia 35 and 37 shown. Further, while ratchets are shown on the top 29 of inner cap 3 and the underside of the top 11 of outer cap 5, these could be reversed so that the blocks are on the inner cap and the ratchets are on the outer cap. Further, these ratchets and blocks could be on the side walls rather than on the tops, without exceeding the scope of the present invention.

Figure 5:
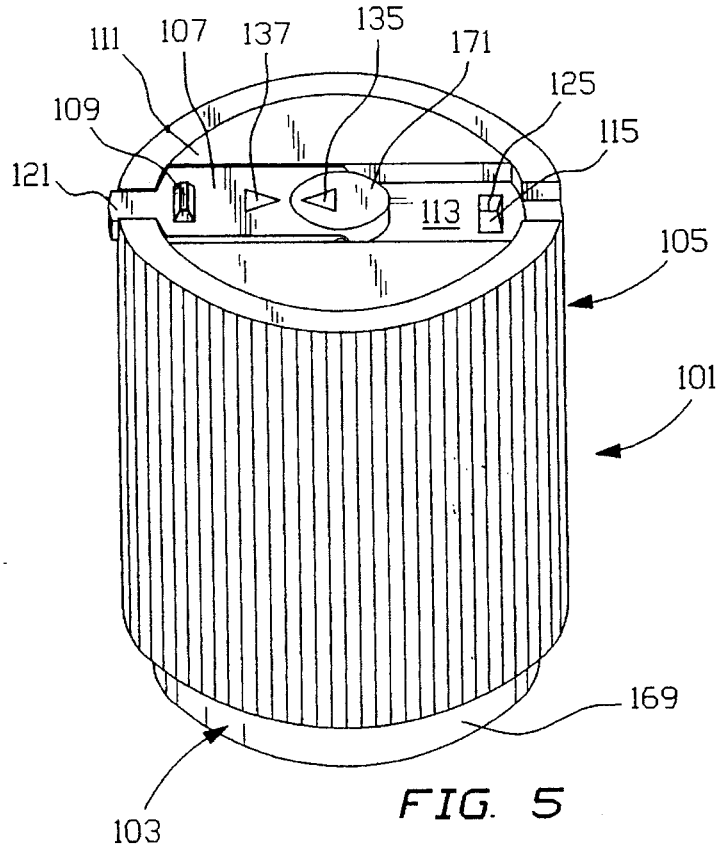
FIG. 5 shows a perspective view of an alternative present invention device.
Figure 6:
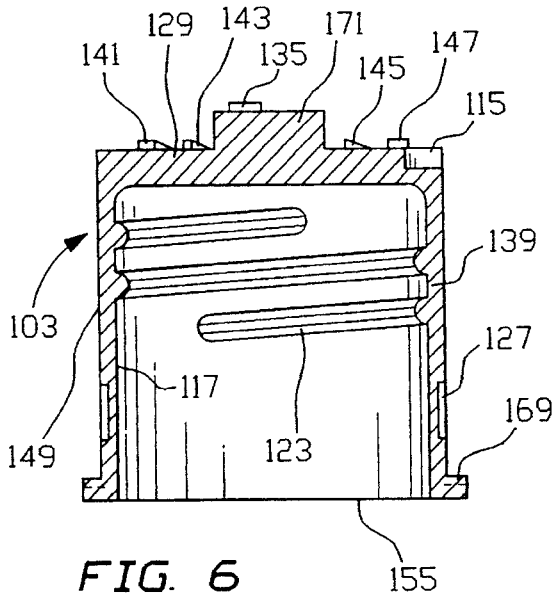
FIG. 6 shows a front cut view of the inner cap thereof.
Figure 7:
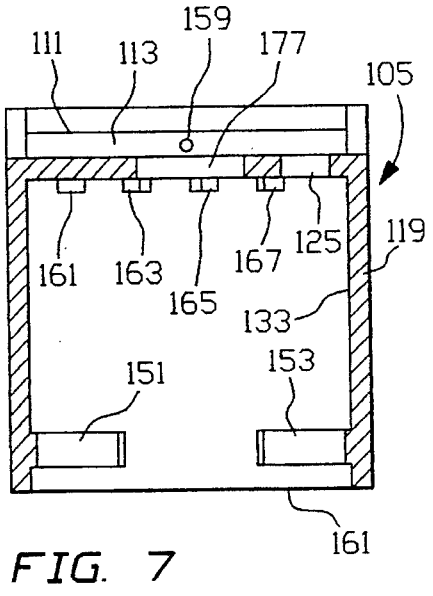
FIG. 7 shows a cut front view of the outer cap thereof.

Referring now to FIG. 2, there is shown a device 101 which is similar to device 1 in FIGS. 1 through 4 but with minor differences as described. FIG. 5 shows a front perspective view of present invention cap device 101 and FIGS. 6 and 7 show front cut views of inner cap 103 and outer cap 105, respectively. Then components are generally the same as those described with respect to FIGS. 1 through 4, as follows, there is an inner cap 103 and an outer cap 105 with a key bar 107 and a release key 109 on key bar 107. There is also a key release finger grip 121, located on key bar 107, as shown. Outer cap 105 includes top 111 and side wall 119. There is a recess 113 for receiving key bar 107 and there is a key orifice 125 located on outer cap 105 as shown. Inner cap 103 includes a key engagement 115, as shown.

Inner cap 103 has an inside side wall 117 which includes threads 123, as shown. Additionally, female attachment means 127 is a horizontal continuous recess located on the outside 149 of side wall 139 of inner cap 103.

The top 129 of inner cap 103 includes ratchets 141, 143, 145 and 147. Additionally, and different from that described above, there is a central protrusion 171 which includes on its top an indicia 135 for proper alignment. This protrusion 131 extends through central orifice 177 located on outer cap 105 as shown. This would enable a manufacturer to attach key bar 107 either to protrusion 171, or to the side wall of recess 113 as shown herein, as exemplified by pin receiving recess 159. Inside side wall 133 of outer cap 105 includes male attachment means 151 and 153 and these would snap into female attachment means 127 when the two are fitted together. Ledge 169 is shown to act as a stop and to otherwise establish contiguous outer surfaces of the inner cap 103 and 105, although this is optional. Inner cap 103 has an open bottom 155 and outer cap 105 has an open bottom 161, as shown. The key bar 107 includes an indicia 137 (an arrow) for alignment with indicia 135. Indicia 135 could be pointed in a different direction and indicia 137 could be located on top 111 instead of on key bar 107, as the manufacturer may desire.

The devices of the present invention further have an essential spacial relationship between the location of the release key engagement and the key orifice on the inner cap and the outer cap, respectively, on the one hand, and the ratchets and ratchet blocks on the other hand. After the cap is removed from the container, it is reapplied to the container in a clockwise manner. The inner cap builds up torque on the container as it is twisted on by rotations of the outer cap with the pivot bar engaged. As the outer cap continues to rotate, while the inner cap stops, the pivot bar ramps out of its key engagement location to release the key, and the closure is thus repositioned in a child resistant mode. Note that the one way ratchets and blocks are located in such a manner that when the pivot bar is engaged, the one way ratchets are not engaged and there is ample space between the ratchets and ratchet blocks to permit ramping release of the pivot bar before the ratchets and blocks engage. Thus, when the cap is reapplied to the container, the outer cap is free to ramp and rotate to some extent, while the inner cap does not move, allowing the pivot bar to ramp out of its locked position before the one way ratchets engage.

Obviously, numerous modifications and variations of the present invention are possible in light of the above teachings. It is therefore understood that within the scope of the appended claims, the invention may be practiced otherwise than as specifically described herein.

What is claimed is:

1. A child resistant cap device for containers having a threaded neck opening, which comprises:

(a) an inner cap having a sidewall and a top, each of said sidewall and top having an inside and an outside, said sidewall having threads on its inside for threading to a container having a threaded neck opening, said sidewall having on its outside, one of a male attaching means and a female attaching means for receiving and attaching an outer cap onto said inner cap so as to be rotatably fixed thereon, said top of said inner cap having a release key engagement on its outside, said outside of said inner cap having one of one way ratchets and ratchet blocks, to permit engagement of an outer cap for rotating said inner cap and an outer cap in a single, closing direction and preventing engagement of an outer cap and said inner cap for rotating said inner cap and an outer cap in a single, opposite, opening direction;

(b) an outer cap having a sidewall and a top, each of said sidewall and top having an inside and an outside, said sidewall having on its inside the other of a male attaching means and a female attaching means for attaching said outer cap to said inner cap so as to be rotatably fixed thereon, said top of said outer cap having a release key attached thereto so as to be invertable by pivotal rotation of about 180°, said top of said outer cap also having a key orifice thereon so as to permit protrusion therethrough of said key to engage said release key engagement of said inner cap, said outside of said outer cap having the other of said one way ratchets and ratchet blocks, aligned with said one of either one way ratchets or ratchet blocks of said inner cap so a to permit engagement therewith, in a single, closing direction and so as to pass over one another in a single, opposite opening direction so as to permit closing but not opening of said inner cap; and, (c) a key bar having a release key thereon, being generally located on the outside of the top of said outer cap, and being attached to at least one of said top of said outer cap and said top of said inner cap so as to be invertable by pivotal rotation, so as to permit protrusion of said key of said key bar through said key orifice so as to be engageable with said key engagement of said inner cap so as to permit opening of said inner cap by rotation of said outer cap when said release key is engaged in said release key engagement.

2. The cap device of claim 1 wherein said top of said outer cap includes a key bar recess, said key bar has a first position within said recess wherein said release key is not inserted into said key orifice, and a second position within said recess wherein said release key is inserted into said key orifice.

3. The cap device of claim 1 wherein said inner cap has said one way ratchets located on its outside top and said outer cap has its ratchet blocks located in alignment therewith on its inside top.

4. The cap device of claim 1 wherein said inner cap has a male attaching means which comprises at least one bead, and said outer cap has a female attaching means which comprises a continuous horizontal recess.

5. The cap device of claim 1 wherein said outer cap has a central opening in its top and said inner cap has a protrusion on the outside of its top for insertion therein.

6. The cap device of claim 1 wherein said key engagement will hold said key in an opening rotational direction and is ramped to release said key in a closing rotational direction.

7. The cap device of claim 1 wherein said inner cap and said outer cap have alignment indicia for aligning said release key bar on said outer cap with said inner cap for insertion of said release key bar into said release key engagement on said inner cap.

8. The cap device of claim 7 wherein said top of said outer cap includes a key bar recess, said key bar has a first position within said recess wherein said release key is not inserted into said key orifice, and a second position within said recess wherein said release key is inserted into said key orifice.

9. The cap device of claim 7 wherein said inner cap has said one way ratchets located on its outside top and said outer cap has its ratchet blocks located in alignment therewith on its inside top.

10. The cap device of claim 7 wherein said inner cap has a male attaching means which comprises at least one bead, and said outer cap has a female attaching means which comprises a continuous horizontal recess.

11. The cap device of claim 7 wherein said outer cap has a central opening in its top and said inner cap has a protrusion on the outside of its top for insertion therein.

12. The cap device of claim 7 wherein said key engagement will hold said key in an opening rotational direction and is ramped to release said key in a closing rotational direction.

13. The cap device of claim 7 wherein said alignment indicia are located on the outside sidewall of said inner cap and said outer cap and said inner cap sidewall has a height greater than said outer cap sidewall so as to extend below said outer cap.

14. The cap device of claim 1 wherein said one way ratchets and said ratchet blocks are located on the outside top of said inner cap and the inside top of said outer cap.

15. The cap device of claim 7 wherein said one way ratchets and said ratchet blocks are located on the outside top of said inner cap and the inside top of said outer cap.

16. A child resistant cap device and container having a threaded neck opening, which comprises:

(a) an inner cap having a sidewall and a top, each of said sidewall and top having an inside and an outside, said sidewall having threads on its inside for threading to a container having a threaded neck opening, said sidewall having on its outside, one of a male attaching means and a female attaching means for receiving and attaching an outer cap onto said inner cap so as to be rotatably fixed thereon, said top of said inner cap having a release key engagement on its outside, said outside of said inner cap having one of one way ratchets and ratchet blocks, to permit engagement of an outer cap for rotating said inner cap and an outer cap in a single, closing direction and preventing engagement of an outer cap and said inner cap for rotating said inner cap and an outer cap in a single, opposite, opening direction;

(b) an outer cap having a sidewall and a top, each of said sidewall and top having an inside and an outside, said sidewall having on its inside the other of a male attaching means and a female attaching means for attaching said outer cap to said inner cap so as to be rotatably fixed thereon, said top of said outer cap having a release key attached thereto so as to be invertible by pivotal rotation of about 180°, said top of said outer cap also having a key orifice thereon so as to permit protrusion therethrough of said key to engage said release key engagement of said inner cap, said outside of said outer cap havingn the other of said one way ratchets and ratchet blocks, aligned with said one of either one way ratchets or ratchet blocks of said inner cap so as to permit engagement therewith, in a single, closing direction and so as to pass over one another in a single, opposite opening direction so as to permit closing but not opening of said inner cap;

(c) a key bar having a release key thereon, being generally located on the outside of the top of said outer cap, and being attached to at least one of said top of said outer cap and said top of said inner cap so as to be invertible by pivotal rotation, so as to permit protrusion of said key of said key bar through said key orifice so as to be engageable with said key engagement of said inner cap so as to permit opening of said inner cap by rotation of said outer cap when said release key is engaged in said release key engagement; and, (d) a container having a threaded neck thereon, aligned with said inner cap threads, for receiving said inner cap.

* * * * *